US005992282A

United States Patent [19]

Biondi et al.

[11] Patent Number: 5,992,282

[45] Date of Patent: Nov. 30, 1999

[54] DEVICE FOR CUTTING CONTINUOUS CIGARETTE RODS

[75] Inventors: Andrea Biondi, Bologna; Fiorenzo Draghetti, Medicina, both of Italy

[73] Assignee: G.D Societa' Per Azioni, Bologna, Italy

[21] Appl. No.: 08/771,956

[22] Filed: Dec. 23, 1996

[30] Foreign Application Priority Data

Dec. 21, 1995 [IT] Italy ..... B095A0597

[51] Int. Cl.[6] ..... B26D 7/00

[52] U.S. Cl. ..... 83/310; 83/339; 83/373

[58] Field of Search ..... 83/300, 310, 339, 83/345, 350, 352, 353, 355, 373, 289, 440, 441

[56] References Cited

U.S. PATENT DOCUMENTS

| | | | |
|---|---|---|---|
| 3,241,413 | 3/1966 | Erdmann | 83/310 |
| 3,479,913 | 11/1969 | Goemann et al. | 83/310 |
| 3,633,448 | 1/1972 | Maw | 83/310 |
| 3,730,034 | 5/1973 | Preston | 83/310 |
| 3,760,672 | 9/1973 | Labee et al. | 83/310 |
| 3,850,065 | 11/1974 | Labbe et al. | 83/310 |
| 4,398,438 | 8/1983 | Seragnoli | 83/310 |

FOREIGN PATENT DOCUMENTS

| | | |
|---|---|---|
| 2023054 | 8/1970 | France . |
| 2406399 | 5/1979 | France . |
| 494488 | 3/1930 | Germany . |
| 1170305 | 11/1969 | United Kingdom . |

*Primary Examiner*—M. Rachuba
*Attorney, Agent, or Firm*—Klauber & Jackson

[57] ABSTRACT

On a machine for producing at least one continuous cigarette rod, the rod is guided along a given path through a cutting station where it is cut into portions by a cutting device wherein a supporting body, fitted with a counterblade for supporting and guiding the rod, and with a blade movable on the supporting body and through a transverse slit on the counterblade, is moved about an axis crosswise to the path of the rod to move the counterblade along a circular trajectory tangent to the path of the rod at the cutting station.

11 Claims, 3 Drawing Sheets

DEVICE FOR CUTTING CONTINUOUS CIGARETTE RODS

BACKGROUND OF THE INVENTION

The present invention relates to a device for cutting continuous cigarette rods.

On cigarette manufacturing machines, at least one continuous cigarette rod is formed and fed axially and continuously through a cutting station where it is cut transversely by a cutting head into a succession of portions for supply to a follow-up, e.g. filter assembly, machine.

On known cigarette manufacturing machines, the cutting station normally comprises a tubular element—hereinafter referred to as a "counterblade"—which is coaxial with the path of the continuous cigarette rod through the cutting station, is movable back and forth in the traveling direction of the cigarette rod, is engaged, in use, in sliding manner by the cigarette rod, and is divided substantially into two integral parts by an intermediate transverse slit through which the cutting head moves during the cutting operation. In other words, just before and during the cutting operation, the counterblade moves in the traveling direction of and at the same speed as the cigarette rod, which is supported on either side of the cut by the two portions of the counterblade, so that the accuracy and neatness of the cut depends on how narrow the transverse slit is.

On most known machines, the counterblade and the cutting head are connected to the ends of respective drives, the only common feature of which is that they are so linked as to enable the counterblade to move with the cigarette rod when this is engaged by the cutting head, normally by means of a blade inclined in relation to the cigarette rod so that, during the cutting operation, the point of contact between the blade and the cigarette rod travels in the same direction and at the same speed as the rod. The fact that the counterblade and the cutting head are connected to different drives inevitably results in a lack of synchronization and, hence, the need for a relatively wide transverse slit in the counterblade.

One solution to the above drawback is proposed in French Patent Application n. 78 29 511, wherein the cutting head is mounted for rotation on a reciprocating support, which travels with the cigarette rod during the cutting operation and supports the counterblade in a fixed position.

Such a solution presents several drawbacks, mainly due to the vibration induced in the machine as a whole by the reciprocating movement of the cutting head, which is relatively heavy.

SUMMARY OF THE INVENTION

It is an object of the present invention to provide a cutting device designed to overcome the drawbacks typically associated with the above known devices.

According to the present invention, there is provided a cutting device for cutting continuous cigarette rods, and comprising guide means for guiding at least one continuous cigarette rod along a given path extending through a cutting station; a supporting body; a counterblade for supporting and guiding said cigarette rod, the counterblade being parallel to said path, being integral with the supporting body, and presenting an intermediate transverse slit; and a blade fitted to the supporting body and movable, in relation to the supporting body, through said slit; characterized by comprising first actuating means for rotating the supporting body about a first axis crosswise to said path to move said counterblade at a given speed along a first circular trajectory tangent to said path at said cutting station; and second actuating means for moving the blade through said slit when the slit is located at said cutting station.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
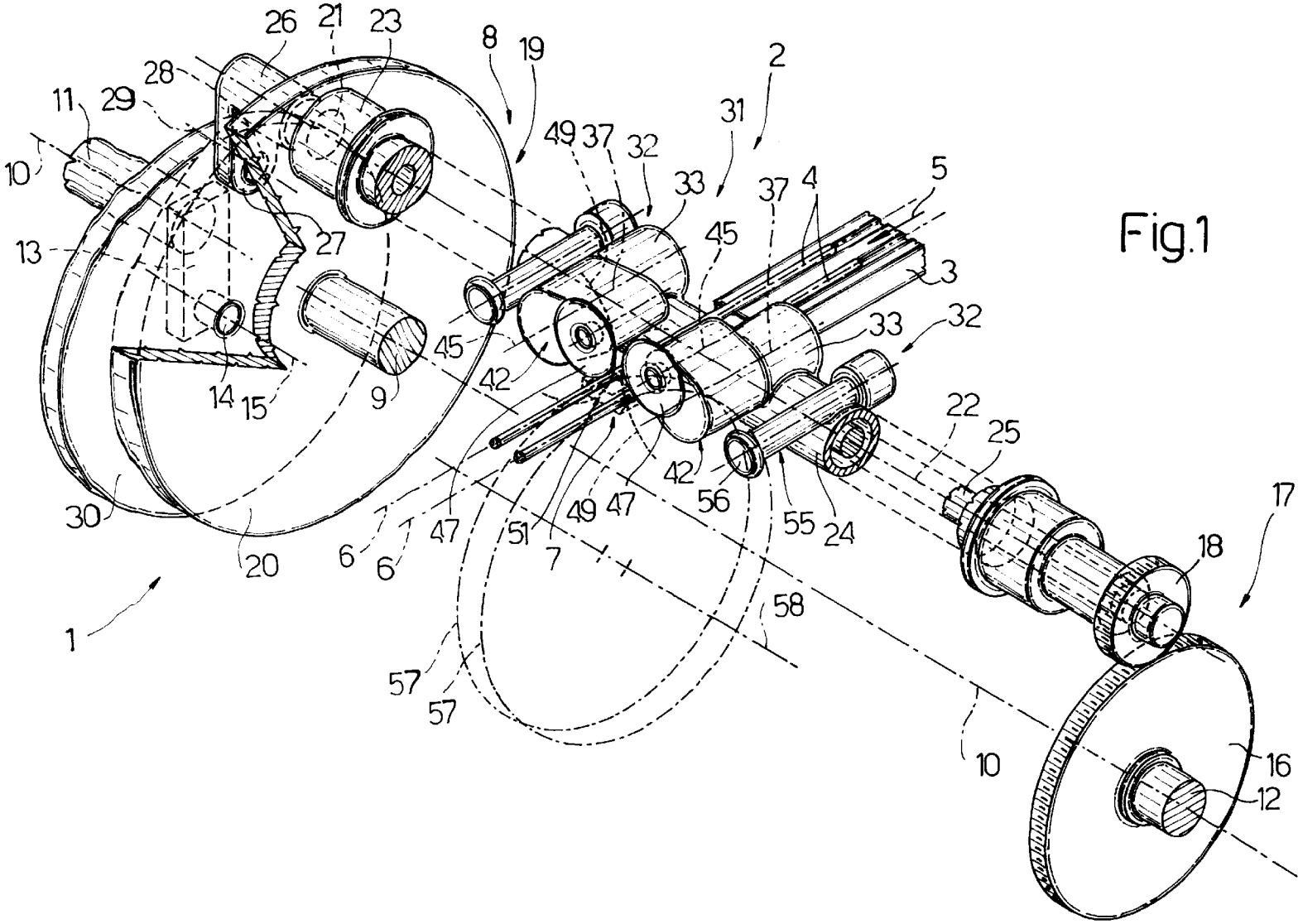
FIG. 1 shows a schematic view in perspective, with parts in section and parts removed for clarity, of a preferred embodiment of the cutting device according to the present invention.

Number 1 in FIG. 1 indicates a cigarette manufacturing machine, an output portion 2 of which comprises a bed 3 for supporting and guiding two parallel, side by side continuous cigarette rods 4 traveling at substantially constant speed and in an axial direction 5 along a substantially horizontal path 6 through a cutting station 7 located at the output end of bed 3.

In addition to bed 3, output portion 2 also comprises a cutting unit 8 located at cutting station 7 and in turn comprising a drive shaft 9 rotating at substantially constant speed about a substantially horizontal axis 10 extending beneath path 6 and crosswise to direction 5. Unit 8 also comprises a first and second fixed shaft, 11 and 12, coaxial with axis 10 and located at either end of shaft 9. At the end facing shaft 12, shaft 11 is fitted integral with a downward-facing square arm 13 fitted on its free end with a pin 14, the axis 15 of which is parallel to and located a given distance D from axis 10; and shaft 12 is fitted with a gear forming a fixed sun gear 16 of an epicyclic gear train 17 comprising at least one planetary gear 18. In actual fact, gear train 17 comprises a number of planetary gears 18 (only one shown for the sake of simplicity) equally spaced about axis 10 and moved about axis 10 by a carrier 19 integral with drive shaft 9.

As shown in FIG. 1, carrier 19 comprises a disk 20 fitted to the opposite end of shaft 9 to that facing sun gear 16, and presenting, for each planetary gear 18, a peripheral through pin 21 fitted in rotary manner to disk 20 and presenting an axis 22 coaxial with respective planetary gear 18. Carrier 19 also comprises, for each pin 21, a bell 23, the end wall of which is integral with the end of pin 21 facing sun gear 16; and a tubular body 24 extending coaxially with axis 22 and fixed at one end inside bell 23. From the end of body 24 opposite that connected to bell 23, there projects the end of a shaft 25, which is supported inside body 24 so as to rotate about axis 22, and is fitted with respective planetary gear 18.

At the end opposite that connected to bell 23, pin 21 is fitted with a square bracket 26, one arm 27 of which extends downwards, crosswise to axis 22, and is fitted in rotary manner on its free end with a pin 28, the axis 29 of which is parallel to and separated from axis 22 by a distance equal to distance D between axes 10 and 15. Pin 28 engages in rotary manner a through hole (not shown) formed in the periphery of a control disk 30, which is fitted idly to pin 14 and rotated about axis 15 by drive shaft 9 via pins 21 (only one shown) and respective arms 27. Disk 30 is off-centered in relation to disk 20 by distance D, and, as it rotates about axis 15, obviously at the same speed as disk 20 and shaft 9, maintains arms 27 (only one shown) parallel to themselves and to arm 13 as disk 20 rotates about axis 10. Consequently, as disk 20 rotates about axis 10, tubular bodies 24 (only one shown) travel parallel to themselves at all times about axis 10.

Figure 2:
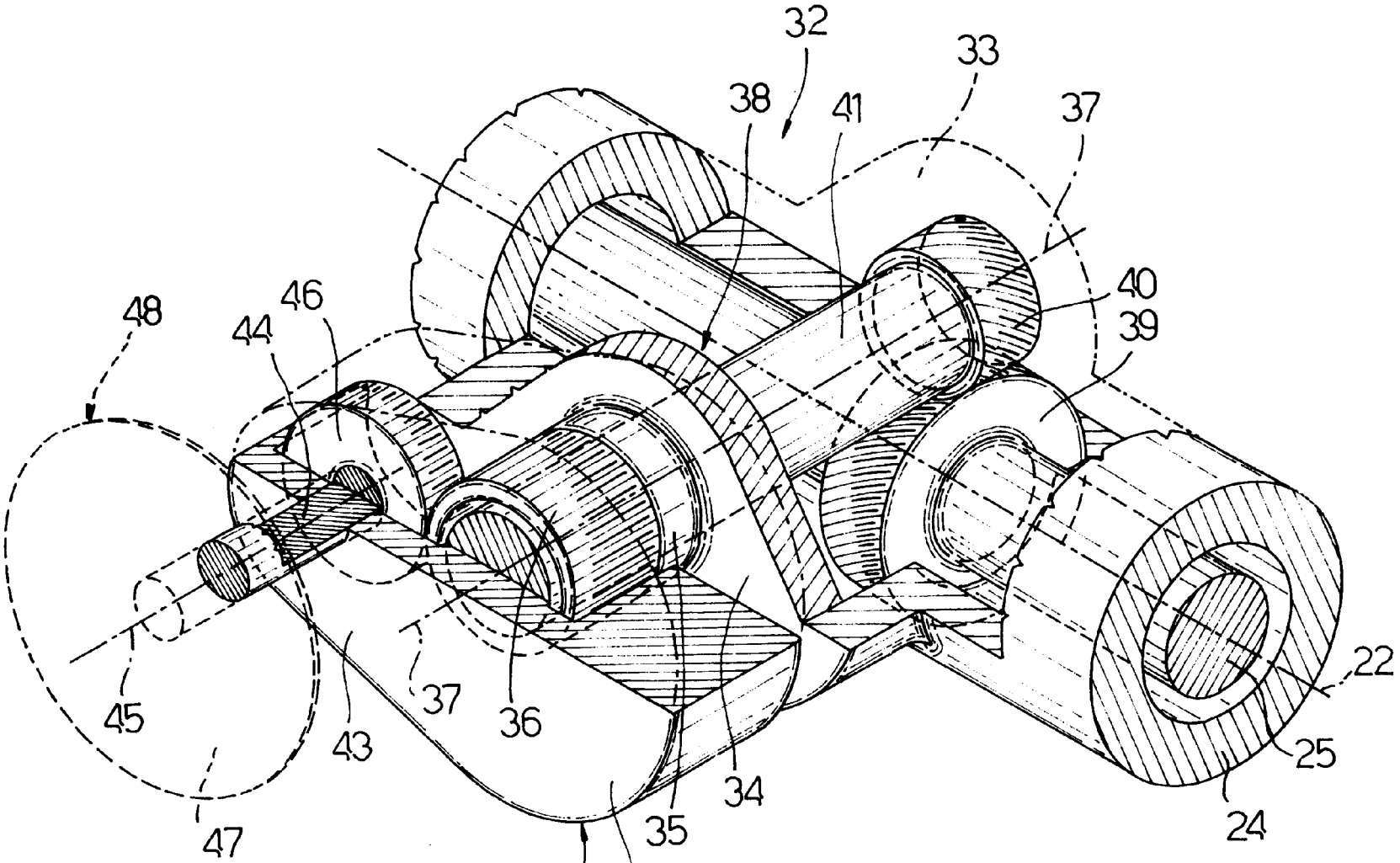
FIG. 2 shows a larger-scale schematic view in perspective, with parts in section and parts removed for clarity, of a first detail in FIG. 1.

Each body 24 forms a supporting body for a respective cutting assembly 31 defined by two cutting devices 32 arranged side by side on body 24 and for cutting respective cigarette rods 4. Devices 32 are located on either side of and specular in relation to paths 6, and each comprise, as shown in FIG. 2 (relative to device 32 to the right of paths 6 in FIG. 1), a box body 33 projecting from body 24 in direction 5 and defined at the front, i.e. on the opposite side to that connected to body 24, by a flat wall 34, which is maintained crosswise to direction 5 at all times by disk 30, and is fitted through with a tubular bushing 35 integral with wall 34 and presenting outer teeth 36 and an axis 37 parallel to direction 5. Bushing 35 communicates with a chamber 38 defined by bodies 24 and 33, and which is fitted through with a portion of shaft 25 fitted with a helical gear 39 meshing with a helical gear 40 formed on the rear end of a shaft 41 coaxial with axis 37. Shaft 41 is supported in rotary manner by bushing 35, and presents a front end projecting frontwards of bushing 35 and connected integral with an intermediate portion of a cutting head 42 comprising an arm 43 extending crosswise to axis 37, and a counterweight 43*a*. Close to its free end, arm 43 presents a through hole engaged in rotary manner by a shaft 44, the axis 45 of which is parallel to axis 37. The rear end of shaft 44 is fitted with a gear 46 meshing with teeth 36; and the front end of shaft 44, to the front of arm 43, is fitted with a circular blade 47 presenting a circular outer cutting edge 48, which, as head 42 rotates about axis 37, travels along a circular trajectory 49 about axis 37.

Figure 3:
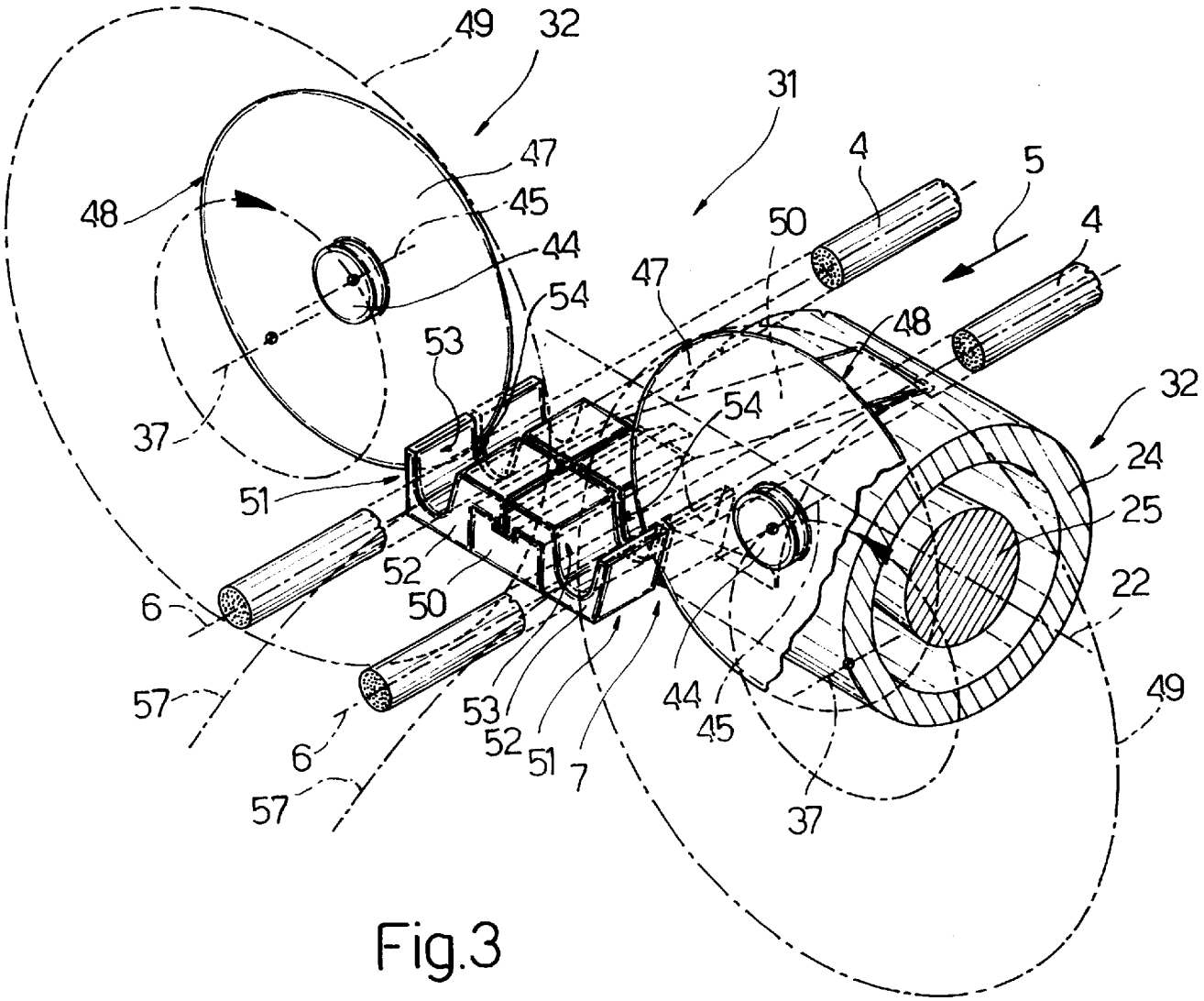
FIG. 3 shows a larger-scale schematic view in perspective, with parts in section and parts removed for clarity, of a second detail in FIG. 1.

As shown more clearly in FIG. 3, an appendix 50 projects frontwards from body 24, is located in an intermediate position between the two box bodies 33, is substantially parallel to direction 5, and is fitted integrally on its free end with two side by side counterblades 51, each of which is defined by a plate 52 substantially in the form of a rectangular prism and presenting a top groove 53 parallel to respective path 6, so that counterblade 51 is substantially U-shaped with its concavity facing upwards. Each counterblade 51 presents an intermediate transverse slit 54 extending the full width of groove 53 and which is engaged by respective blade 47, the trajectory 49 of edge 48 of which extends through slit 54.

As shown in FIG. 1, each cutting device 32 comprises a sharpening device 55 fitted to body 24 and in turn comprising a preferably powered grinding wheel 56 tangent to trajectory 49.

In actual use, shaft 9, as stated, rotates carrier 19 about axis 10 at substantially constant speed, and, by means of disk 30, the angular position of assemblies 31 (only one shown) is so controlled that they translate about axis 10 with axes 45 of blades 47 parallel at all times to paths 6 and direction 5. As assemblies 31 translate about axis 10, the point of intersection between the axis of each groove 53 and the plane of respective slit 54 travels along a circular trajectory 57, which is tangent to relative path 6 at station 7, and presents an axis 58 below and parallel to axis 10, so that, for each complete turn of shaft 9 about axis 10, each counterblade 51 is positioned tangent to relative cigarette rod 4 at station 7. If, as in the example shown, disk 20 is rotated anticlockwise in FIG. 1 at such a speed that the linear speed of counterblades 51 equals the traveling speed of cigarette rods 4 along respective paths 6, each counterblade therefore travels through station 7 in direction 5 at the same speed as relative cigarette rod 4. That is, each counterblade 51 travels through station 7 at the same speed as and supporting cigarette rod 4.

As regards each device 32, as planetary gear 18 rolls about fixed sun gear 16, shaft 25 is rotated about axis 22 so that head 42 rotates about axis 37; and, at the same time, gear 46 meshes with teeth 36 to rotate blade 47 about respective axis 45.

Connections 39–40 of each assembly 31 are such that the two heads 42 are rotated in opposite directions and in time with each other about respective axes 37. More specifically, heads 42 to the left and right of paths 6 in FIG. 1 respectively rotate clockwise and anticlockwise about respective axes 37, so that respective blades 47 travel downwards through respective slits 54 and cut respective rods 4 by pressing them on to respective counterblades 51.

By appropriately timing assemblies 31 (only one shown) and relative heads 42, each blade 47 may be fed through respective slit 54 to cut relative rod 4 as respective counterblade 51 travels through station 7.

In connection with the above, it should be pointed out that, since each counterblade 51 travels with respective blade 47 along respective trajectory 57, the clearance between blade 47 and counterblade 51 may be very small, as may the width of respective slit 54, thus enabling a precise "clean" cut of relative rod 4 by blade 47. And this by means of a number of rotational movements at substantially constant speed, i.e. with substantially no vibration.

As already stated, though FIG. 1 shows a cutting unit 8 comprising only one cutting assembly 31, in actual practice, unit 8 may of course comprise a number of assemblies 31 equally spaced about axis 10, the number of assemblies 31 depending on the ratio between the traveling speed of rods 4 and the linear speed of assemblies 31.

In the event machine 1 is designed to produce only one cigarette rod 4, each cutting assembly 31 will obviously comprise only one cutting device 32.

We claim:

1. A cigarette manufacturing machine comprising a cutting station (7), a cutting unit arranged in said cutting station for cutting continuous cigarette rods, and guide means for guiding at least one continuous cigarette rod along a given path extending through said cutting station at a given speed; said cutting unit having at least one cutting assembly comprising a supporting body; first actuating means for rotating the supporting body about a first axis; a counterblade integral with the supporting body and having a groove parallel to said path for supporting and guiding said cigarette rod, and an intermediate transverse slit perpendicular to said groove; and at least one cutting device, which is connected to the supporting body in a fixed position in relation to said counterblade, and comprises a movable blade and second actuating means for moving said blade through said slit when the slit is located at said cutting station; said first actuating means being provided for rotating the supporting body about said first axis to move said counterblade and said cutting device at said given speed along a first circular trajectory tangent to said path at said cutting station.

2. A machine as claimed in claim 1 wherein said first actuating means comprise control means cooperating with said supporting body to maintain said groove parallel to said path at all times as the supporting body travels along said first trajectory.

3. A machine as claimed in claim 1, further comprising a cutting head fitted in rotary manner to said supporting body so as to rotate, by virtue of said second actuating means, about a second axis substantially parallel to said path; the cutting head supporting said blade.

4. A machine as claimed in claim 3, wherein said blade is a circular blade fitted to said cutting head eccentrically in relation to the second axis, and presenting a peripheral cutting edge; the blade moving together with the cutting head to move said cutting edge along a second circular trajectory extending through said slit.

5. A machine as claimed in claim 4, further comprising third actuating means located on the supporting body and for rotating the blade about a third axis parallel to the second axis.

6. A machine as claimed in claim 5, further comprising a sharpening device fitted to the supporting body and located along said second trajectory, at a given distance from said counterblade.

7. A machine as claimed in claim 4, wherein said counterblade is a double counterblade presenting two side by side grooves for supporting and guiding two said continuous cigarette rods, each groove presenting a respective through said transverse slit; said supporting body supporting two said cutting heads located on either side of said counterblade and each presenting a respective said circular blade.

8. A machine as claimed in claim 7, wherein said two cutting heads are fitted to said supporting body so as to rotate in opposite directions about respective said second axis.

9. A machine as claimed in claim 1, comprising two said cutting assembly arranged about said first axis, and having in common said first actuating means.

10. A machine as claimed in claim 1, wherein said counterblade is substantially U-shaped.

11. A machine as claimed in claim 9, wherein said counterblade is substantially U-shaped.

* * * * *